United States Patent [19]

McDonald

[11] 4,131,085

[45] Dec. 26, 1978

[54] VAPOR GENERATING UNIT BLOWDOWN ARRANGEMENT

[75] Inventor: Bertrand N. McDonald, Lynchburg, Va.

[73] Assignee: The Babcock & Wilcox Company, New York, N.Y.

[21] Appl. No.: 793,682

[22] Filed: May 4, 1977

[51] Int. Cl.[2] ..... F22B 37/54

[52] U.S. Cl. ..... 122/382; 122/32

[58] Field of Search ..... 122/32, 33, 34, 382

[56] References Cited

U.S. PATENT DOCUMENTS

| | | | |
|---|---|---|---|
| 3,139,070 | 6/1964 | Sprague et al. | 122/34 |
| 3,811,498 | 5/1974 | Ferraro et al. | 122/32 |
| 3,913,531 | 10/1975 | von Hollen | 122/382 |
| 3,915,122 | 10/1975 | Schroder | 122/382 |
| 3,942,481 | 3/1976 | Bennett | 122/382 |

*Primary Examiner*—Kenneth W. Sprague

*Attorney, Agent, or Firm*—Joseph M. Maguire; Angelo Notaro

[57] ABSTRACT

A vapor generating unit having a U-shaped tube bundle is provided with an orificed downcomer shroud and a fluid flow distribution plate between the lower hot and cold leg regions to promote fluid entrained sediment deposition in proximity to an apertured blowdown pipe.

4 Claims, 2 Drawing Figures

VAPOR GENERATING UNIT BLOWDOWN ARRANGEMENT

BACKGROUND OF THE INVENTION

1. Field of Invention

This invention relates to a shell and U-tube vapor generating unit in which heat is supplied by a hot fluid flowing within the tubes, and more particularly, to an improved arrangement for the de-entrainment and blowdown of sediment.

2. Summary of the Prior Art

The use of shell and U-tube type vapor generating units, particularly in nuclear power plant steam generator applications, is well known.

Typically, the unit is contained within a vertically elongated pressure vessel of circular cross section and consists of a fluid heated inverted U-tube bundle disposed in the lower portion of the vessel within a circular shroud which forms an interior vapor generating chamber and an annular shaped downcomer bounded by the shroud and the vertical wall of the pressure vessel. Both ends of each tube are connected to a tubesheet located at one end of the vessel transversely of the longitudinal centerline of the vessel.

During operation of the unit a hot "primary" fluid, such as water, liquid metal or gas, enters one end of the tubes and flows through the tube bundle wherein it transfers heat before discharging at the opposite end of each tube. The leg of each U-tube receiving the hot fluid is generally characterized as a "hot leg". Conversely, the leg from which the cooled fluid is discharged is known as the "cold leg". The hot legs are usually grouped on one side of a vertical center plane of the vessel and the cold legs on the opposite side.

Water or another vaporizable "secondary" liquid descends through the annular downcomer to the tubesheet and radially enters the vapor generating chamber flowing into the spacing outside of the closely packed bundle of tubes, generally through a continuous circumferential opening between the bottom of the shroud and the upper surface of the tubesheet. The secondary liquid passes up over the outside of the tubes due to the thermal siphonic effect of the heat being transferred from the hot primary fluid, and is vaporized.

It is known that matter entrained in a flowing liquid separates therefrom and settles at points where the liquid velocity and the resulting turbulence are low. Tube failures and localized tube corrosion have been observed to be coincident with such sediment deposition. The velocity distribution of the secondary fluid, therefore, is of considerable importance in providing for sediment removal.

Blowdown pipes have been commonly utilized in vapor generating units to remove sediment deposited in the vicinity of the tubesheet by providing blowdown procedures in which the affected area receives a periodic or continuous flushing. Blowdown means have been located in the gap between the hot and cold legs. This location is desirable because it does not necessitate the omission of any tubes from a symmetrical tube bundle pattern which would result in the loss of heat transfer surface for a given unit volume. Experience has shown, however, that central location of the blowdown pipes has not effectively removed sediment that deposits on the tubesheet in the hot leg area. Recent analyses, moreover, indicate that the secondary fluid velocity distribution across the tubesheet from the periphery of the tube bundle is influenced by the higher vapor generation rate that occurs in the hot leg region of a U-tube bundle. It has been discovered that the effects of higher net vapor generation in the hot leg region is such that the area of null transverse velocity and low turbulence occurs in the midst of the hot leg region. Hence, sediment deposition in the hot leg region at the tubesheet appears to be predominant in these units. On more recent vapor generating units, therefore, blowdown arrangements have been provided in the hot leg region at the area of minimum velocity, necessitating the omission of a significant number of tubes from the tube bundle.

Thus, there exists a need to provide an efficient means of sediment removal at the tubesheet of a vapor generating unit of the type described above without the omission of tubes.

SUMMARY OF THE INVENTION

In accordance with the present invention, a blowdown arrangement is provided in a vertical shell and U-tube vapor generating unit, wherein the lower portion of the spacing between the hot legs and cold legs is separated by a vertically oriented flow distribution plate disposed superjacent to an apertured blowdown pipe and wherein the shroud is orificed to control flow into the hot leg and cold leg portions of the U-tube bundle.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
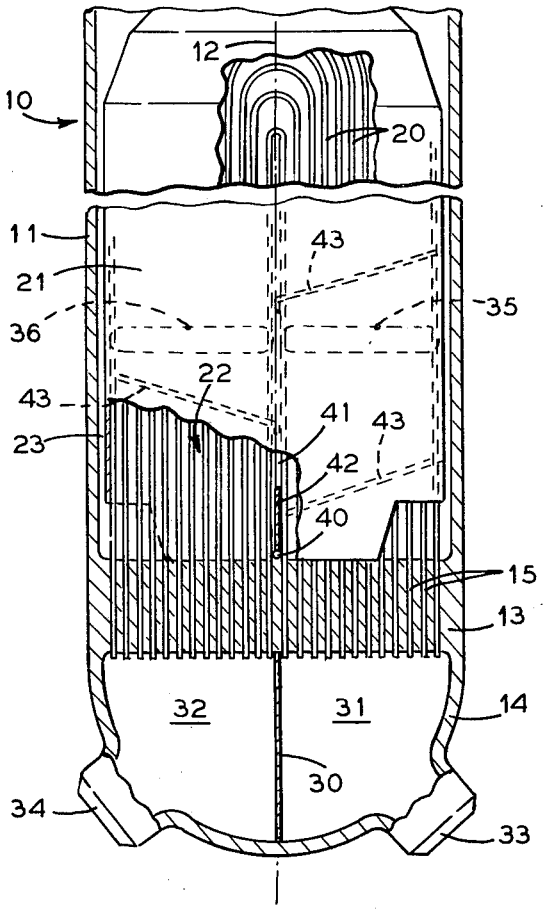
FIG. 1 is a vertical side section of a vapor generating unit utilizing the innovation disclosed herein.

Referring now to the drawings in detail, FIG. 1 illustrates a portion of a vapor generating unit 10 including a vertically elongated pressure vessel 11 of circular cross section having a longitudinal center line 12, a tubesheet 13 located transversely of the longitudinal center line, and a hemispherical head 14 closing the lower end thereof. The tubesheet 13, which is generally disposed between the lower end of the vessel 11 and the lower head 14, has a multiplicity of tube receiving openings 15 formed therein.

A multiplicity of inverted U-shaped tubes constituting a vertically elongated bundle 20 is disposed in the lower portion of the vessel 11 within a generally circular shroud 21 which forms an interior vapor generating chamber 22 and an annular shaped downcomer 23 that is bounded by the shroud and the vertical wall of the pressure vessel. The tube ends of the U-shaped tubes of the tube bundle 20 are received in the tube receiving openings 15 of the tubesheet 13 and fixed in a fluid tight manner.

A dividing baffle 30 is fastened to the lower face of the tubesheet and, in conjunction with the hemispherical head 14, forms a fluid inlet chamber 31 and outlet chamber 32. Inlet and outlet nozzles 33 and 34, respectively, provide the means for passage of a hot fluid into inlet chamber 31, through the tubes of the tube bundle 20 and out the outlet chamber 32 to the outlet nozzle 34, thereby forming a hot leg tube portion 35 on the right of FIG. 1 and a cold leg tube portion 36 on the left of FIG. 1.

Figure 2:
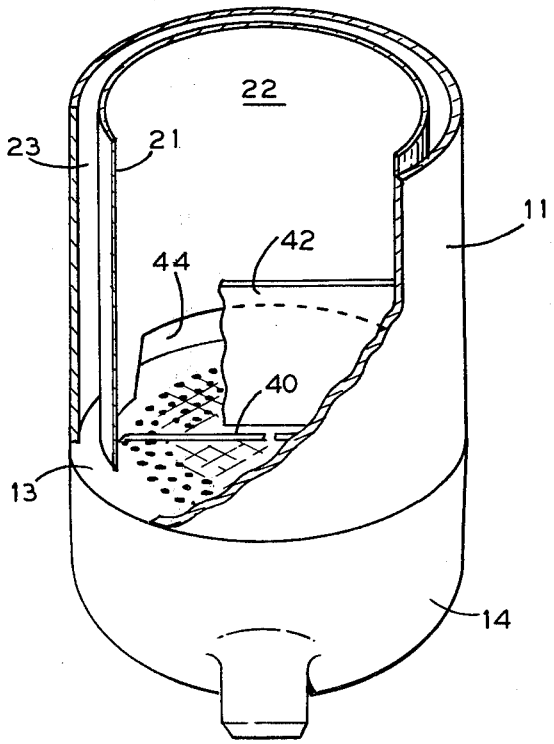
FIG. 2 is a schematic representation of a blowdown arrangement in accordance with the invention.

As is best shown in FIGS. 1 and 2 means are provided to effectively remove sediment deposited on the tubesheet. An apertured blowdown pipe 40 is disposed within the vapor generating chamber 22 adjacent to the tubesheet 13 in a spacing 41 that exists generally between the hot and cold legs of the U-tube bundle. A vertically oriented flow distribution plate 42 is disposed in close superjacent proximity with the blowdown pipe 40. A plurality of tube support plates 43 laterally support and maintain the tubes in a fixed transversely spaced relationship.

As is shown in FIG. 2, the shroud 21 is provided with one of more apertures or windows 44 within the shroud on each side of the flow distribution plate 42 such that flow into the lower hot and cold leg sides of the vapor generation chamber can be controlled.

During operation of the unit, a hot fluid flows through the tubes of the tube bundle 20 wherein it gives up heat before passing out of the unit. A vaporizable liquid fills the downcomer 23 and a portion of the vapor generating chamber 22. Due to the thermal siphonic effect of the hot fluid within the tubes, the vaporizable liquid flows from the downcomer 23 through the window 44 and up through the tube bundle 20 within the vapor generation chamber 22. As the liquid passes up therethrough, a vapor-liquid mixture or "wet" vapor is generated. The vapor-liquid mixture then flows through a moisture separation apparatus (not shown ) and the separated vapor is discharged out of a vapor outlet and flows to a point of use, e.g. a turbine. The separated liquid is generally recirculated within the vapor generating unit to mix with incoming secondary liquid.

The flow distribution plate 42 precludes cross flow from the cold leg portion to the hot leg portion in the vicinity of the tubesheet. In the preferred embodiment, the plate 42 transversely divides the vapor chamber so that the fluid entering the hot and cold legs is kept separated until it passes the first tube support plate 43. The windows 44 in the shroud 21 are designed to permit controlled amounts of liquid flow into the hot and cold legs to account for the differences in vapor generation in these regions of the vapor generation chamber. Hence, the fluid draw from the cold leg region into the hot leg region at the tubesheet is essentially eliminated and the null point of the radial velocity component occurs in the vicinity of the flow distribution plate. The apertured blowdown pipe 40 which in the preferred embodiment is longitudinally spaced in close proximity below the flow distribution plate 42, communicates with the exterior of the pressure vessel 11. Secondary fluid communication, i.e., blowdown, is effected by the continuous flow of fluid from the vapor chamber 22 to the exterior of the vessel through apertures in the blowdown pipe and, thence, through the pipe. Shutoff means, typically a valve, are generally located outside of the vessel within a pipe communicating with the blowdown line to effect a periodic blowdown, if desired. The window 44 sizes and locations facing the hot leg and cold leg portions may be varied to yield predetermined flow directions and velocities in the lower part of the bundle so that the location of sediment deposition can be predicted and blowdown means provided to minimize sediment accumulation. The windows can be designed to distribute the vaporizable liquid as desired to provide uniform vapor quality at the top of the tube bundle. Hence, de-entrainment of the entrained sediment in the secondary fluid can be accomplished at the spacing 41 near the tubesheet and the omission of tubes for blowdown purposes is no longer required.

It will be evident to those skilled in the art that changes may be made, e.g., such as extending the flow distribution plate to the tubesheet and locating separate blowdown pipes on either side of the flow distribution plate without departing from the spirit of the invention covered in the claims.

I claim:

1. In combination with a vapor generating unit of the type having a vertically elongated pressure vessel of circular cross section housing a fluid heated U-tube bundle that has hot leg and cold leg portions attached to a tubesheet, a generally cylindrical shroud radially spaced between the pressure vessel vertical wall and the U-tube bundle to form an interior vapor chamber and an annular shaped downcomer bounded by the shroud and the wall of the pressure vessel and means for radially passing a vaporizable secondary fluid into the vapor chamber from the downcomer, an improved means of de-entraining and removing sediment entrained in the secondary fluid comprising a vertical plate disposed between the hot leg and the cold leg, means for proportionately regulating secondary fluid flow into the hot and cold legs and blowdown means in the vapor chamber communicating with the exterior of the pressure vessel.

2. An improved means of de-entraining and removing sediment entrained in the secondary fluid as set forth in claim 1 wherein the shroud has a plurality of apertures for controlling secondary fluid into the hot and cold legs.

3. An improved means of de-entraining and removing sediment entrained in the secondary fluid as set forth in claim 2 wherein said vertical plate is disposed superjacent to said blowdown means.

4. An improved means of accumulating and removing sediment entrained in the secondary fluid as set forth in claim 3 wherein said blowdown means further comprises an apertured blowdown pipe.

* * * * *